United States Patent [19]

Nagasaka et al.

[11] Patent Number: 5,071,373

[45] Date of Patent: Dec. 10, 1991

[54] CONNECTOR WITH A TERMINAL LOCKING BLOCK

[75] Inventors: Yasuhiro Nagasaka; Yasuo Hirayama; Hirotaka Noda, all of Aichi; Naoto Taguchi; Takeya Miwa, both of Shizuoka, all of Japan

[73] Assignee: Yazaki Corporation, Tokyo, Japan

[21] Appl. No.: 663,128

[22] Filed: Mar. 4, 1991

[30] Foreign Application Priority Data

Mar. 5, 1990 [JP] Japan ..... 2-21472
Nov. 30, 1990 [JP] Japan ..... 2-126554

[51] Int. Cl.[5] ..... H01R 13/514
[52] U.S. Cl. ..... 439/752; 439/595
[58] Field of Search ..... 439/594, 595, 752

[56] References Cited

U.S. PATENT DOCUMENTS 4,946,398 8/1990 Takenouchi et al. ..... 439/595 X
4,998,896 3/1991 Lundergan ..... 439/595

*Primary Examiner*—Eugene F. Desmond
*Attorney, Agent, or Firm*—Armstrong, Nikaido, Marmelstein, Kubovcik & Murray

[57] ABSTRACT

The connector consists of a connector housing having terminal accommodating chambers, and a terminal locking block which is mounted to the rear portion of the connector housing in two steps, first in a provisionally-engaged condition and then in a full-engaged condition. When the terminal locking block is half-coupled to the connector housing, a full-engaging projection member formed on the terminal locking block contacts an inclined guide inner surface formed in a locking block receiving opening in the rear part of the connector housing. At the same time, engagement projections of full-engaging members formed on the terminal locking block abut against the provisionally-engaging portion of the connector housing. In the provisionally-engaged condition, the front ends of terminal holding pieces projecting forwardly from the terminal locking block are located out of the terminal lug insertion paths in the terminal accommodating chambers, so that terminal lugs can freely be inserted into or removed from the terminal accommodating chambers. Moving the terminal locking block from the provisionally-engaged position to the full-engaged position requires disengaging the full-engaging members from the provisionally-engaging portion of the connector housing. This prevents an inadvertent shifting of the terminal locking block into the full-engaged position.

5 Claims, 5 Drawing Sheets

CONNECTOR WITH A TERMINAL LOCKING BLOCK

BACKGROUND OF THE INVENTION

1. Field of the Invention

The present invention relates to a connector used for connecting wiring harnesses and more particularly to a connector structure having a terminal locking block mounted to a connector housing to prevent terminal lugs inserted into the terminal accommodating chambers in the connector housing from slipping off backwardly.

2. Prior Art

A general practice of locking the terminal lugs inserted into the terminal accommodating chambers in the connector housing is by forming flexible engagement pieces integral with the inner walls of the terminal accommodating chambers and then engaging the terminal lugs inserted into the chambers with the flexible engagement pieces to prevent the terminal lugs from slipping off backwardly from the terminal accommodating chambers. In recent years, there has been proposed a structure in which a terminal locking block is mounted to the rear part of the connector housing so that the terminal locking block, either in combination with or in place of the flexible engagement pieces, can reliably prevent the slip-off of the terminal lugs.

FIG. 6 shows an example of a conventional connector structure. A connector housing a has a provisionally-engaging projection b and a full-engaging projection member c formed on the rear part of the outer circumference thereof, with two projections spaced a short distance axially. In a provisionally-engaged condition in which a pair of coupling frames e of a terminal locking block d are engaged with the provisionally-engaging projection b, a terminal lug g already connected with a wire is inserted into a terminal accommodating chamber h through an opening in a base frame f of the terminal locking block d.

The base frame f has, in addition to the paired coupling frames e, a pair of flexible terminal holding pieces i which are disposed parallel to the paired coupling frames e. In the provisionally-engaged condition, the terminal holding pieces i are out of the terminal lug insertion path.

Next, the terminal locking block d is pushed forwardly to engage the coupling frames e with the full-engaging projection member c. In this full-engaged condition, free end portions $i_1$ of the terminal holding pieces i are guided along a tapered drive wall j so that they are curved inwardly to engage with the terminal lug g, thus preventing the backward slip-off of the terminal lug (see FIG. 7).

In the above construction, when an extraneous force as from hand or foreign matter is applied inadvertently to the terminal locking block d in the provisionally-engaged condition, the terminal locking block d may be shifted into the full-engaged condition. When, on the other hand, one wants to pull out the terminal lug g by shifting the terminal locking block d from the full-engaged condition back to the provisionally-engaged condition, the terminal lug g may get caught by the free end portions $i_1$ of the terminal holding pieces i that underwent plastic deformation along the tapered drive wall j.

SUMMARY OF THE INVENTION

The present invention has been accomplished to overcome the above drawbacks and its objective is to provide a connector with a terminal locking block that prevents inadvertent shifting of the terminal locking block from the provisionally-engaged position to the full-engaged position and in which at the provisionally-engaged position the terminal holding pieces of the terminal locking block will not hinder the insertion and removal of the terminal lugs into and from the terminal accommodating chambers.

To achieve the above objective, a connector of this invention comprises: a connector housing having a plurality of terminal accommodating chambers formed therein to receive terminal lugs, said connector housing having a rear opening to receive a terminal locking block and a tapered guide inner surface formed in the rear opening; and a terminal locking block mounted to a rear portion of the connector housing in two steps, first in a provisionally-engaged condition and second in a full-engaged condition; said terminal locking block having terminal holding pieces to be inserted into the corresponding terminal accommodating chambers in the connector housing, said terminal locking block also having full-engaging members and a full-engaging projection member to fix the terminal locking block to the connector housing; whereby when the terminal locking block is attached to the rear portion of the connector housing in the provisionally-engaged condition, the full-engaging members of the terminal locking block abut against the provisionally-engaging portion of the connector housing and the full-engaging projection member of the terminal locking block comes into contact with the tapered guide inner surface so that the attitude of the terminal locking block is controlled in such a way that front ends of the terminal holding pieces of the terminal locking block are located out of terminal lug insertion paths in the terminal accommodating chambers to allow insertion and removal of the terminal lugs; and when the terminal locking block is pushed into the full-engaged condition from the provisionally-engaged condition by disengaging the full-engaging members from the provisionally-engaging portion of the connector housing, the terminal locking block parts from the tapered guide inner surface, causing the front ends of the terminal holding pieces to come into the terminal lug insertion paths in the terminal accommodating chambers and thereby securely engages with the terminal lugs.

PREFERRED EMBODIMENT OF THE INVENTION

Figure 1:
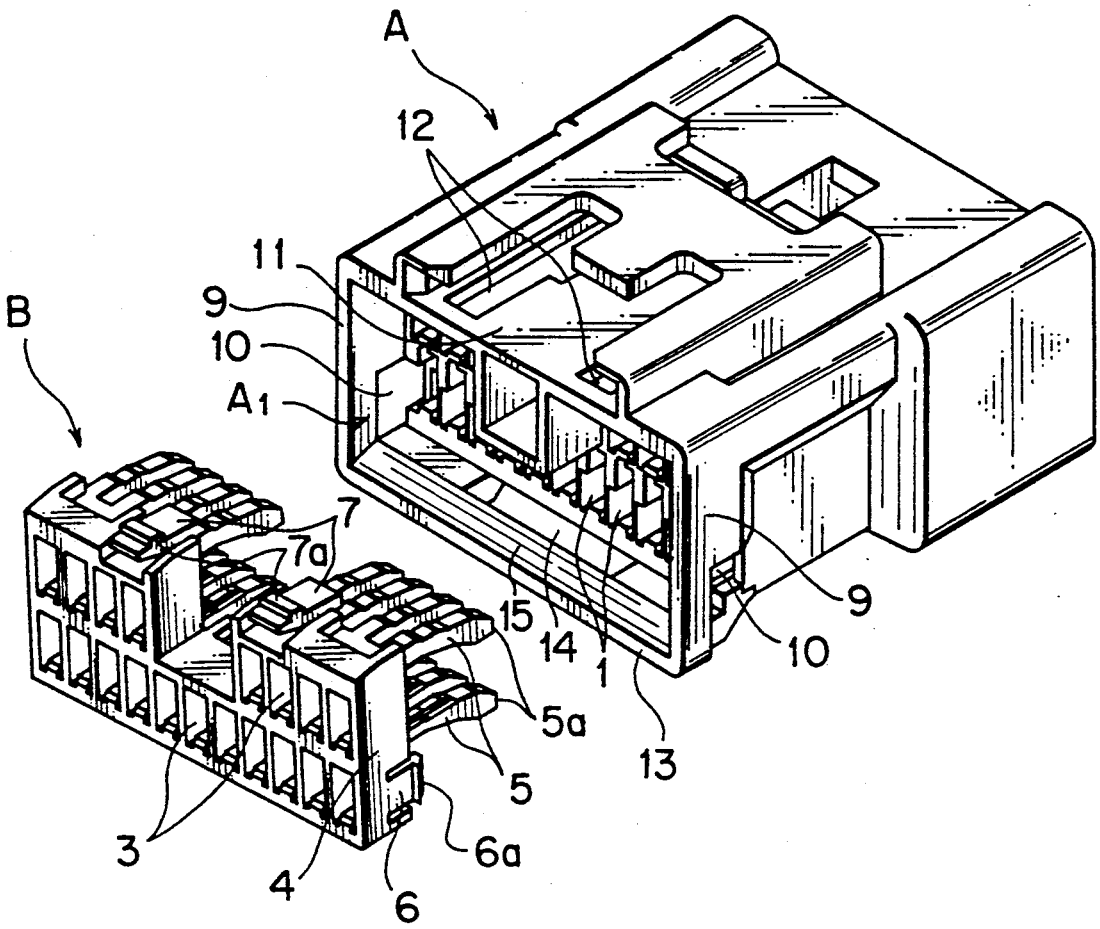
FIG. 1 is a perspective view of one embodiment of this invention showing the terminal locking block detached from the connector housing.

In FIGS. 1 and 2, designated A is a connector housing and B a terminal locking block. The connector housing A made of synthetic resin as one piece has a plurality of terminal accommodating chambers 1 formed therein, in each of which there is provided a flexible engagement piece 2 as a preliminary means of fixing a terminal lug C.

The terminal locking block B, also made of synthetic resin as one piece, has a plurality of terminal insertion openings 3 formed in a base frame 4 at positions corresponding to the terminal accommodating chambers 1. The base frame 4 also has a plurality of flexible terminal holding pieces 5 projecting forwardly from each terminal insertion opening 3 so that when the terminal locking block B is mounted to the connector housing A, these flexible terminal holding pieces 5 are inserted into the respective terminal accommodating chambers 1.

The base frame 4 has provisionally-engaging arms 6 on each side which have engagement projections 6*a*. At the top the base frame 4 has full-engaging members 7 with engagement projections 7*a*; and at the bottom it has a full-engaging projection member 8.

At the rear end of the connector housing A is formed an opening $A_1$ into which the base frame 4 of the terminal locking block B is fitted. Both side walls 9, 9 of the opening $A_1$ are formed with provisionally-engaging holes 10 to receive the provisionally-engaging arms 6; in an upper wall 11 of the opening $A_1$ are formed full-couple holes 12 for mating with the full-engaging members 7; and in a lower wall 13 is formed a full-couple hole 14 for mating with the full-engaging projection member 8.

The inner surface of the rear part of the lower wall 13 is formed with a tapered guide inner surface 15 that is inclined upward inwardly. The outer surface of the full-engaging projection member 8 is formed as a tapered contact surface 16 that slides on the tapered guide inner surface 15.

In this construction, the terminal locking block B is attached to the connector housing A by fitting, from the rear, the base frame 4 of the terminal locking block B into the opening $A_1$ in the connector housing A with the terminal holding pieces 5 inserted into the corresponding terminal accommodating chambers 1. In this first stage of connection, the engagement projections 7*a* of the full-engaging members 7 abut against the provisionally-engaging surface of the upper wall 11 of the opening $A_1$ and at the same time the tapered contact surface 16 of the full-engaging projection member 8 comes into contact with the tapered guide inner surface 15 of the lower wall 13, causing the base frame 4 inclined upward forwardly. At this time, the engagement projections 6*a* of the provisionally-engaging arms 6 are received in the half-couple holes 10, so that the terminal locking block B is loosely connected to the connector housing A in the inclined state. (See FIG. 2*a*).

Figure 2A:
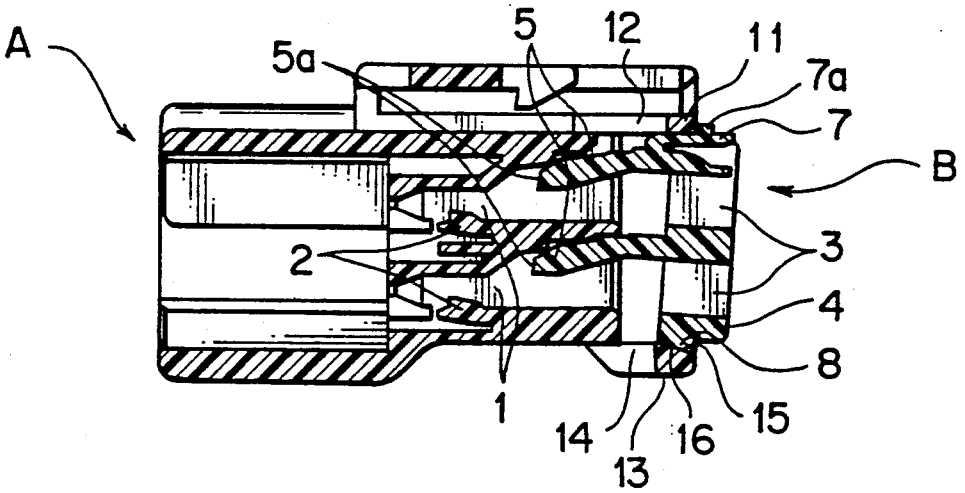
FIGS. 2*a*, 2*b*, 2*c*, 2*d* and 2*e* are cross sections, showing the process of coupling the terminal locking block onto the connector housing from the provisionally-engaged condition to the full-engaged condition.
Figure 2B:
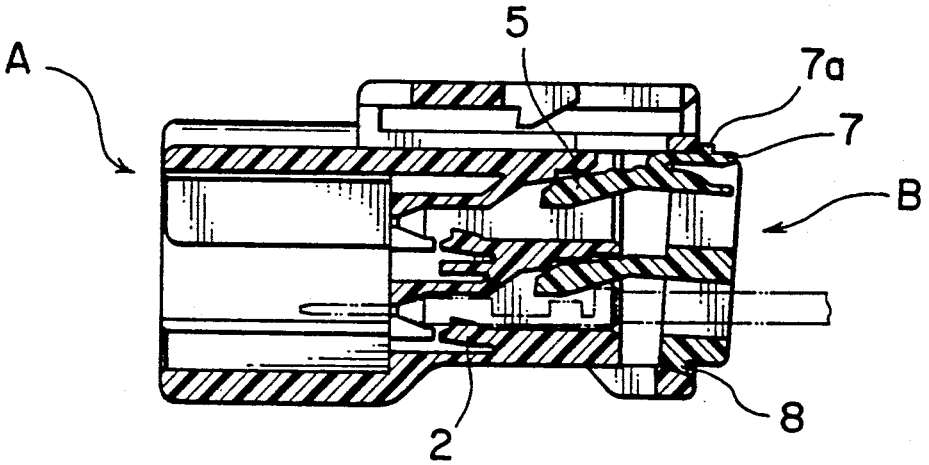

In this loosely coupled or half-coupled condition, since an end 5*a* of the terminal holding piece 5 is out of the insertion passage of the terminal lug C, the terminal lug C can easily be inserted into each terminal accommodating chamber 1 until it is held by the flexible engagement piece 2 (FIG. 2*b*).

Figure 2C:
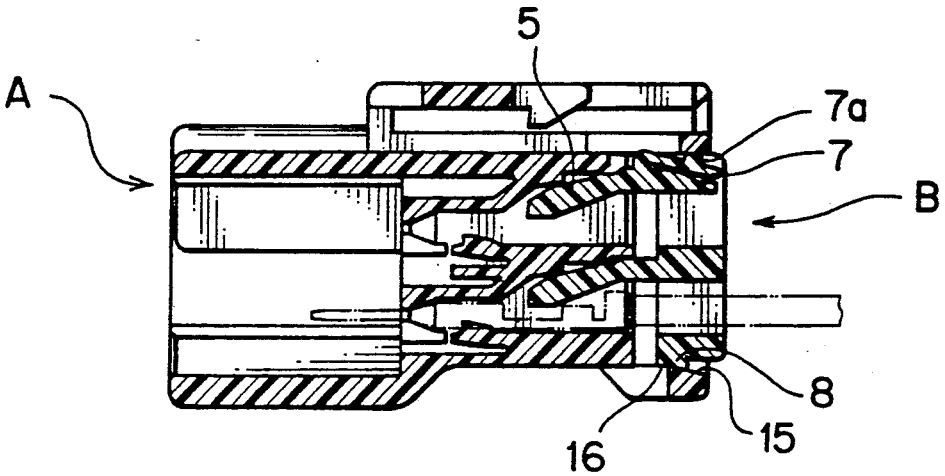
Figure 2D:
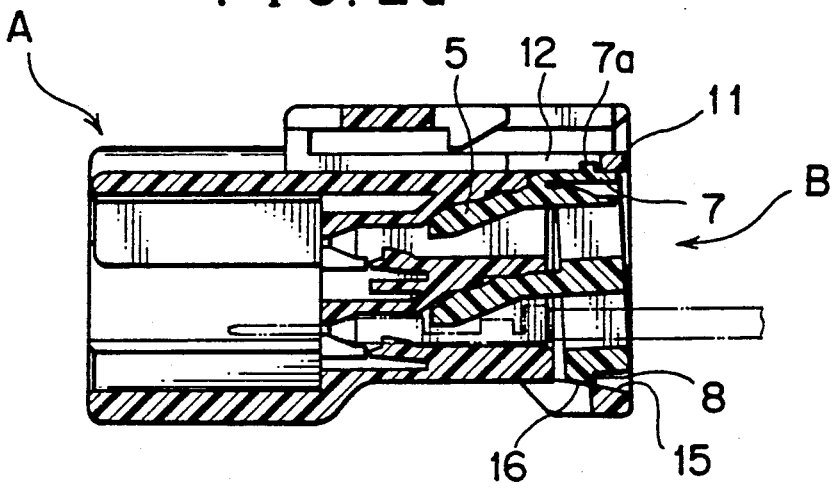
Figure 2E:
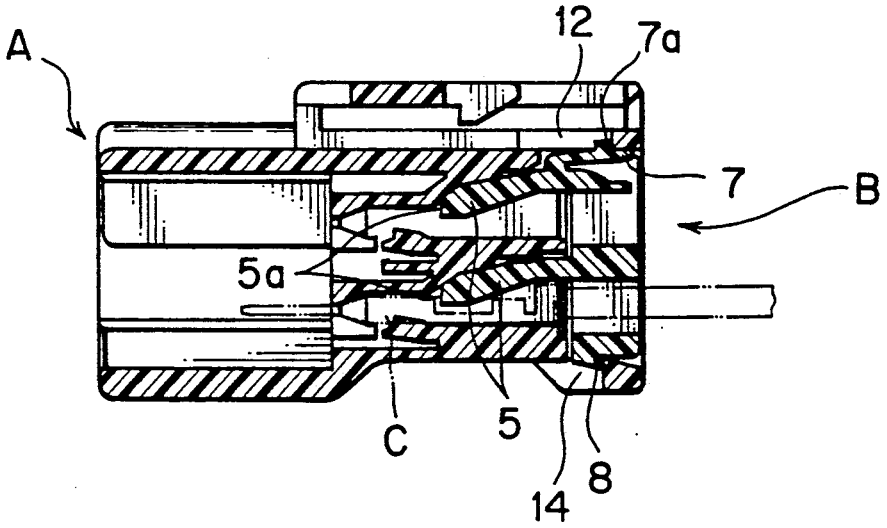

Next, the full-engaging members 7 are pushed down to disengage the engagement projections 7*a* from the provisionally-engaging surface of the upper wall 11 and at the same time the base frame 4 is pushed into the opening $A_1$ (FIG. 2*c*). As the base frame 4 is pushed further inwardly, the engagement pieces 7*a* or full-engaging members 7 clear the restriction of the upper wall 11 and snap into the full-couple holes 12 to restore their original shape. The engagement projections 7*a* now engage with the full-couple holes 12 (FIG. 2*d*). A further push causes the full-engaging projection member 8 to come into engagement with the full-couple hole 14. As a result, the terminal locking block B is now fully coupled to the connector housing A, with the ends 5*a* of the terminal holding pieces 5 fixing the terminal lugs C (FIG. 2*e*). In this way, the terminal lug C is doubly fixed, first by the flexible engagement pieces 2 and second by the terminal holding pieces 5.

The provisionally-engaging holes 10, whose size is set large, allow the movement of the provisionally-engaging arms 6 as the locking block is advanced from the provisionally-engaged condition (FIG. 2*a*) to the full-engaged condition (FIG. 2*e*).

Figure 5:
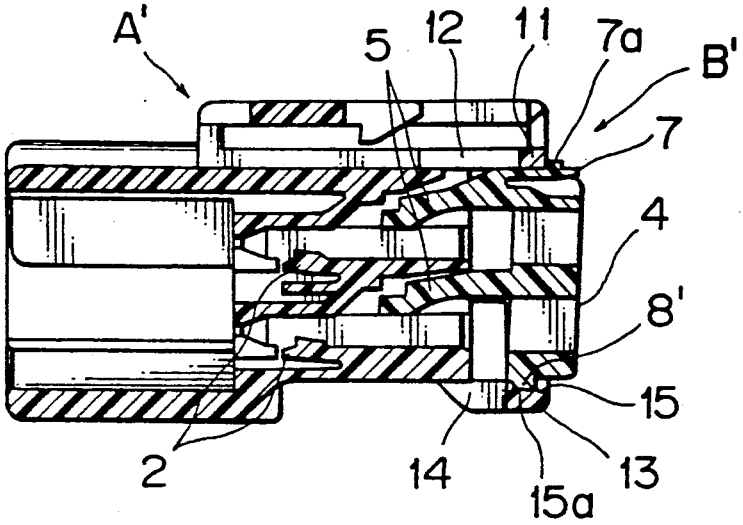
FIG. 5 is a cross section of the connector and the terminal locking block of FIG. 3 and FIG. 4 in the provisionally-engaged condition.
Figure 3:
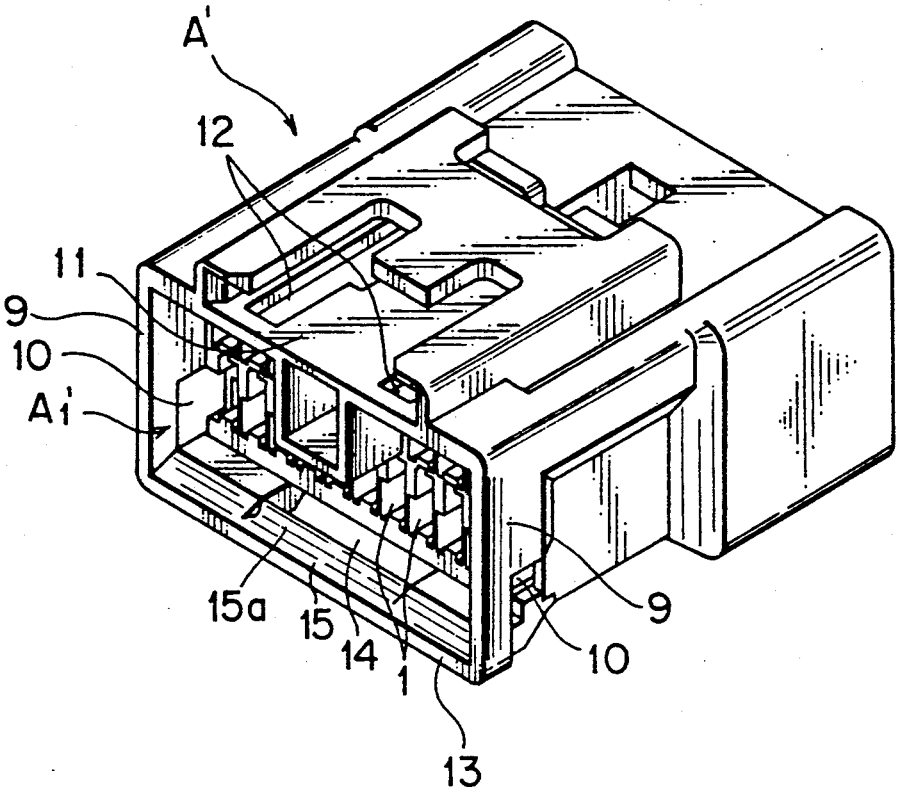
FIG. 3 is a perspective view of another embodiment of connector housing according to this invention.
Figure 4:
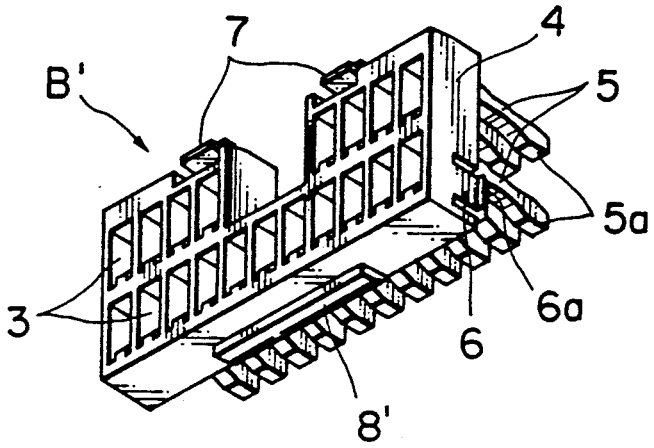
FIG. 4 is a perspective view of another embodiment, seen from below, of the terminal locking block according to this invention.
Figure 6:
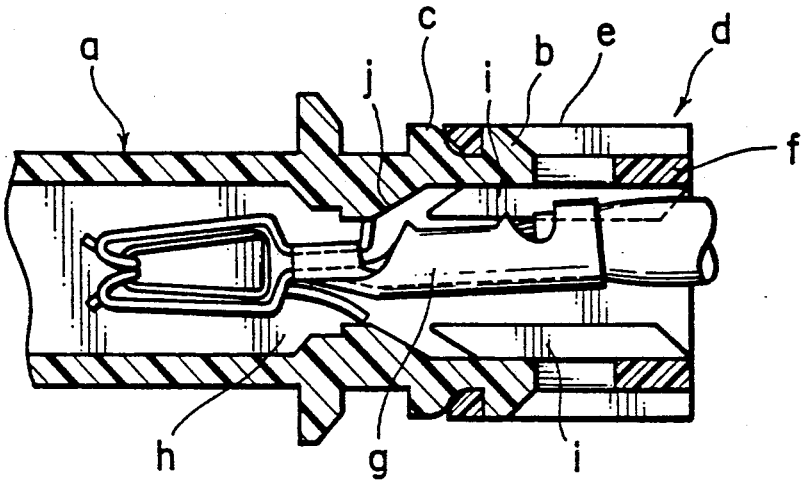
FIG. 6 is a cross section of a conventional connector in the provisionally-engaged condition.
Figure 7:
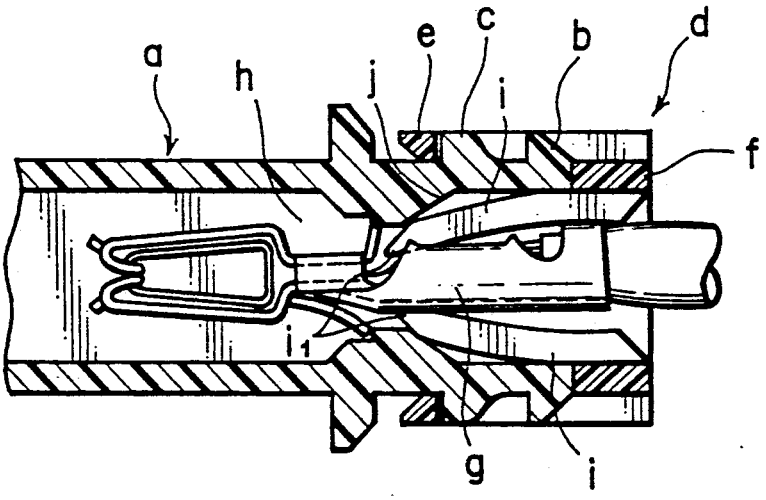
FIG. 7 is a cross section of the conventional connector of FIG. 6 in the-full-engaged condition.

In another embodiment shown in FIGS. 3 to 5, the connector housing A', like the first embodiment, has a tapered guide inner surface 15 that inclines upward inwardly on the rear inner surface of an opening $A_1'$ at the rear part of the lower wall 13. The tapered guide inner surface 15 is formed with a support groove 15*a* that is located close to the full-couple hole 14 and extends in the lateral direction. The terminal locking block B' has a full-engaging projection member 8' on the underside of the base frame 4 that engages with the support groove 15*a*. During the mounting process corresponding to FIGS. 2*a* and 2*b*, the full-engaging projection member 8' is engaged with the support groove 15*a* (FIG. 5) and thus firmly supported so that it works as a fulcrum, enabling the terminal locking block B' to pivot about the full-engaging projection member 8' and shift reliably into the position corresponding to FIG. 2*c*.

The advantages of this invention may be summarized as follows. The connector consists of a connector housing having terminal accommodating chambers; and a terminal locking block having terminal holding pieces to be inserted into the corresponding terminal accommodating chambers. The terminal locking block is mounted to the rear portion of the connector housing in two steps, first in a provisionally-engaged condition and second in a full-engaged condition. In the provisionally-engaged condition, the full-engaging members of the terminal locking block abut against the provisionally-engaging portion of the connector housing and at the same time the terminal locking block comes into contact with the tapered guide inner surface of the connector housing. This engagement controls the attitude of the terminal locking block in such a manner that the ends of the terminal holding pieces are located out of the terminal lug insertion paths in the terminal accommodating chamber. When, with the full-engaging members depressed and disengaged by fingers, the terminal locking block is advanced into the full-engaged condition, the terminal locking block parts from the tapered guide inner surface, causing the ends of the terminal holding pieces to come into the terminal insertion path and engage with the terminal lugs. Because of the two-step coupling process, it is possible to prevent an inadvertent shifting of the terminal locking block from the provisionally-engaged condition into the full-engaged condition. In the provisionally-engaged condition since the terminal holding piece ends of the terminal locking block are kept out of the terminal lug insertion paths in the terminal accommodating chambers, the terminal lugs can easily be inserted or removed.

What is claimed is:

1. A connector with a terminal locking block comprising:

a connector housing having a plurality of terminal accommodating chambers formed therein to receive terminal lugs, said connector housing having a rear opening to receive a terminal locking block and a tapered guide inner surface formed at the rear opening; and a terminal locking block mounted to a rear portion of the connector housing in two steps, first in a provisionally-engaged condition and second in a full-engaged condition; said terminal locking block having terminal holding pieces to be inserted into the corresponding terminal accommodating chambers in the connector housing, said terminal locking block also having full-engaging members and a full-engaging projection member to fix the terminal locking block to the connector housing;

when the terminal locking block is attached to the rear portion of the connector housing in the provisionally-engaged condition, the full-engaging members of the terminal locking block abutting against the provisionally-engaging portion of the connector housing and the full-engaging projection member of the terminal locking block coming into contact with the tapered guide inner surface so that the attitude of the terminal locking block is controlled in such a way that front ends of the terminal holding pieces of the terminal locking block are located out of terminal lug insertion paths in the terminal accommodating chambers to allow insertion and removal of the terminal lugs; and when the terminal locking block is pushed into the full-engaged condition from the provisionally-engaged condition by disengaging the full-engaging members from the provisionally-engaging portion of the connector housing, the terminal locking block parting from the tapered guide inner surface, causing the front ends of the terminal holding pieces to come into the terminal lug insertion paths in the terminal accommodating chambers and thereby securely engage with the terminal lugs.

2. A connector with a terminal locking block as claimed in claim 1, wherein said tapered guide inner surface of the connector housing is formed with a support groove so that in the provisionally-engaged condition the full-engaging projection member of the terminal locking block engages with and is supported by the support groove.

3. A connector with a terminal locking block as claimed in claim 1, wherein said full-engaging members of the terminal locking block each have an engagement projection that abuts against the provisionally-engaging portion of the connector housing when the terminal locking block is provisionally engaged with the connector housing, so that the engagement projections prevent inadvertent shifting of the terminal locking block into the full-engaged condition.

4. A connector with a terminal locking block as claimed in claim 1, wherein said full-engaging members of the terminal locking block is formed on an upper side of the terminal locking block.

5. A connector with a terminal locking block as claimed in claim 1, wherein said full-engaging projection member of the terminal locking block is formed on a lower side of the terminal locking block.

* * * * *